US007491087B2

(12) United States Patent
Swantner et al.

(10) Patent No.: US 7,491,087 B2
(45) Date of Patent: Feb. 17, 2009

(54) RIGHT ANGLED CONNECTOR

(75) Inventors: Michael J. Swantner, Warren, PA (US); Shane Brown, York, PA (US); Douglas G. Seymour, York, PA (US)

(73) Assignee: Osram Sylvania Inc, Danvers, MA (US)

( * ) Notice: Subject to any disclaimer, the term of this patent is extended or adjusted under 35 U.S.C. 154(b) by 943 days.

(21) Appl. No.: 10/759,637

(22) Filed: Jan. 16, 2004

(65) Prior Publication Data

US 2005/0159021 A1 Jul. 21, 2005

(51) Int. Cl.
*H01R 9/05* (2006.01)

(52) U.S. Cl. ..... 439/582; 439/63

(58) Field of Classification Search ..... 439/581–582, 439/578–579, 63, 736
See application file for complete search history.

(56) References Cited

U.S. PATENT DOCUMENTS 4,556,264 A * 12/1985 Tanaka ..... 439/62
4,666,231 A * 5/1987 Sheesley et al. ..... 439/581
5,478,258 A * 12/1995 Wang ..... 439/581
5,897,384 A * 4/1999 Hosler, Sr. ..... 439/63
6,164,977 A * 12/2000 Lester ..... 439/63
6,390,825 B1 * 5/2002 Handley et al. ..... 439/63
6,719,586 B2 * 4/2004 Weidner ..... 439/581
6,776,621 B1 * 8/2004 Dye ..... 439/63

* cited by examiner

*Primary Examiner*—Truc T Nguyen
*Assistant Examiner*—Xuong M Chung-Trans
(74) *Attorney, Agent, or Firm*—William H. McNeill

(57) ABSTRACT

A right-angled electrical connector (30) has a one-piece electrically insulating body (32) molded over a subassembly (10) that includes a first electrically conductive member 12 with a hollow end (16) and an electrical contact (18*a*) mounted within the hollow end (16). In the mold the contact pin (18*a*) is electrically isolated from the member (12) and electrically insulating material of the body 32 flows around the contact pin (18*a*).

4 Claims, 3 Drawing Sheets

RIGHT ANGLED CONNECTOR

TECHNICAL FIELD

This invention relates to electrical connectors and more particularly to such connectors for receiving a coaxial cable contact. Still more particularly, it relates to right angle connectors for use with printed circuit boards.

BACKGROUND ART

Electrical connectors, particularly right angled connectors for attachment to printed circuit boards (hereafter, PCB or PCBs) for receiving coaxial cable contacts, for example, for connecting automotive radio antennas, are known. These connectors have worked well in the past; however, they were expensive because of the number of parts they entailed. Such connectors are shown, for example, in U.S. Pat. No. 6,386,888. This latter connector comprises a metal bracket, a metal shell, a plastic insulator, a plastic cover and a contact. While this connector works well under normal conditions, test requirements for this connector require that it be plugged into a mating connector on a coaxial cable. This mating connector's cable is then pulled at a defined force through multiple angles. Often, the interface of the cover to the bracket will fail before the required forces are met. It is believed that this failure occurs because to the difficulty in maintaining critical tolerances between the multiple parts.

DISCLOSURE OF INVENTION

It is, therefore, an object of the invention to obviate the disadvantages of the prior art.

It is another object of the invention to enhance electrical connectors.

Still another object of the invention is to reduce the number of parts for an electrical connector.

Yet another object of the invention is the provision of a simplified electrical connector, particularly one for mounting to a PCB at one end and attachment or connection to a coaxial cable at another end.

These objects are accomplished, in one aspect of the invention, by the provision of a connector that comprises an electrically conductive member having a longitudinal section at least a portion of which provides a cylindrical hollow end, and an electrically conductive pin positioned with respect to the electrically conductive member. At least a first part of the electrically conductive pin is substantially centrally located within the hollow end, and a single-piece electrically insulating body surrounds the electrically conductive member and the electrically conductive pin.

In a preferred embodiment of the invention the single-piece, electrically insulating body is achieved by over-molding the electrically conductive member and the electrically conductive contact pin as they are held in place in a suitable mold cavity.

The construction thus described provides a connector that comprises only three parts and all of the insulating parts are constructed as a single body. The connector is rigid, easily passing the required bending forces test and is economical to manufacture and assemble.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
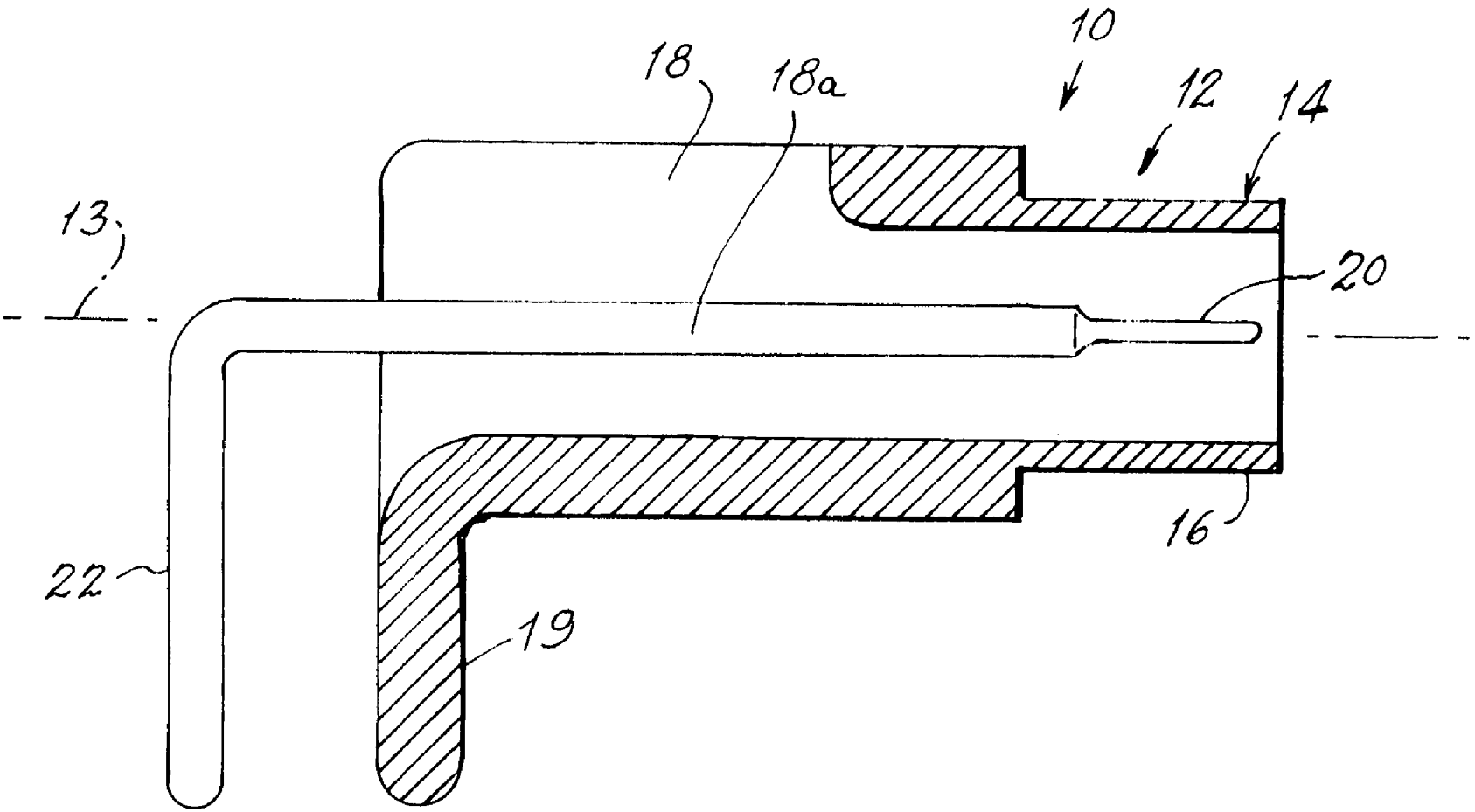
FIG. 1 is a sectional view of a subassembly of a connector with an electrically conductive member having an electrically conductive contact pin received in a hollow end of the conductive member.
Figure 2:
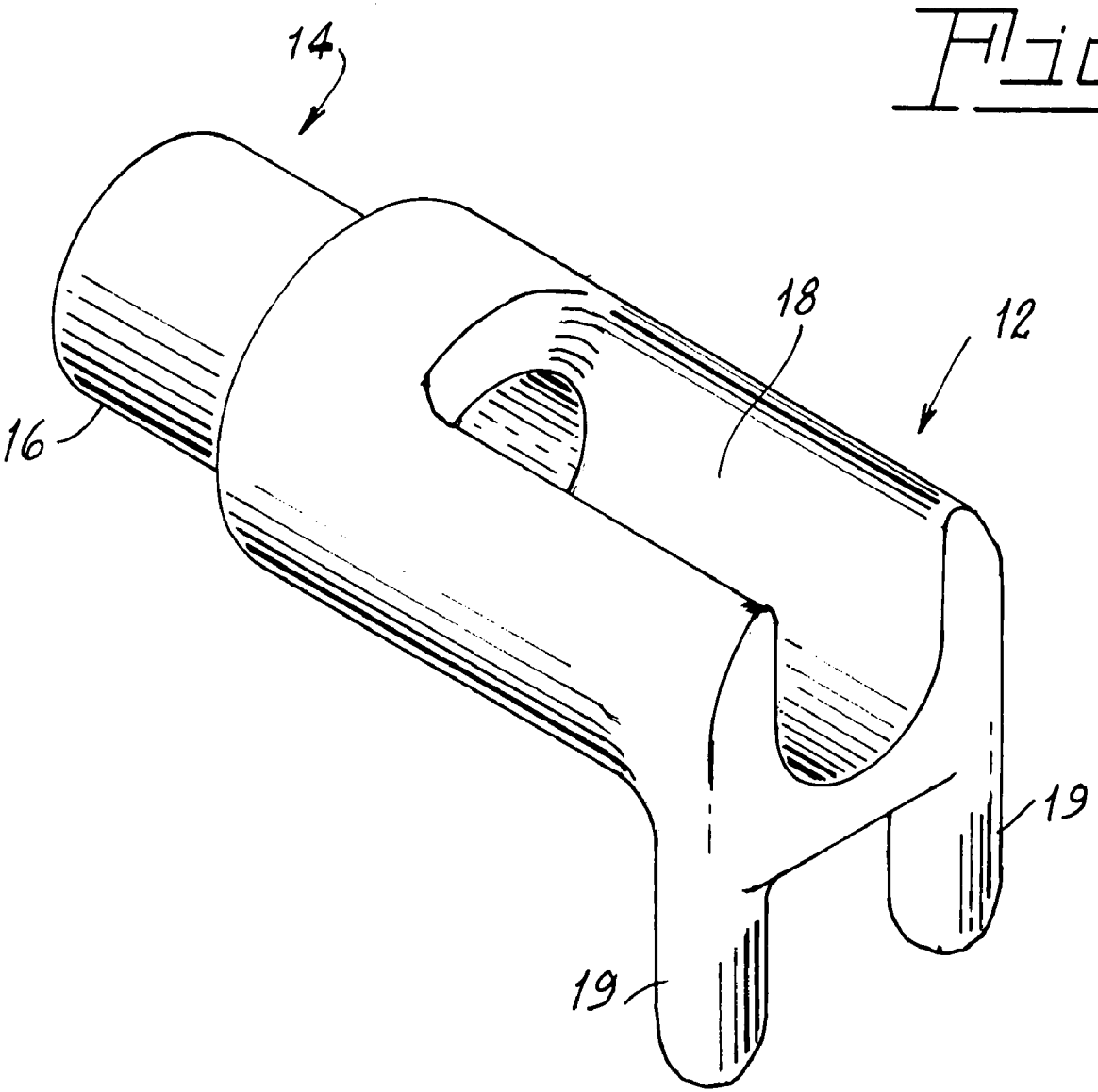
FIG. 2 is a perspective view of the electrically conductive member.
Figure 3:
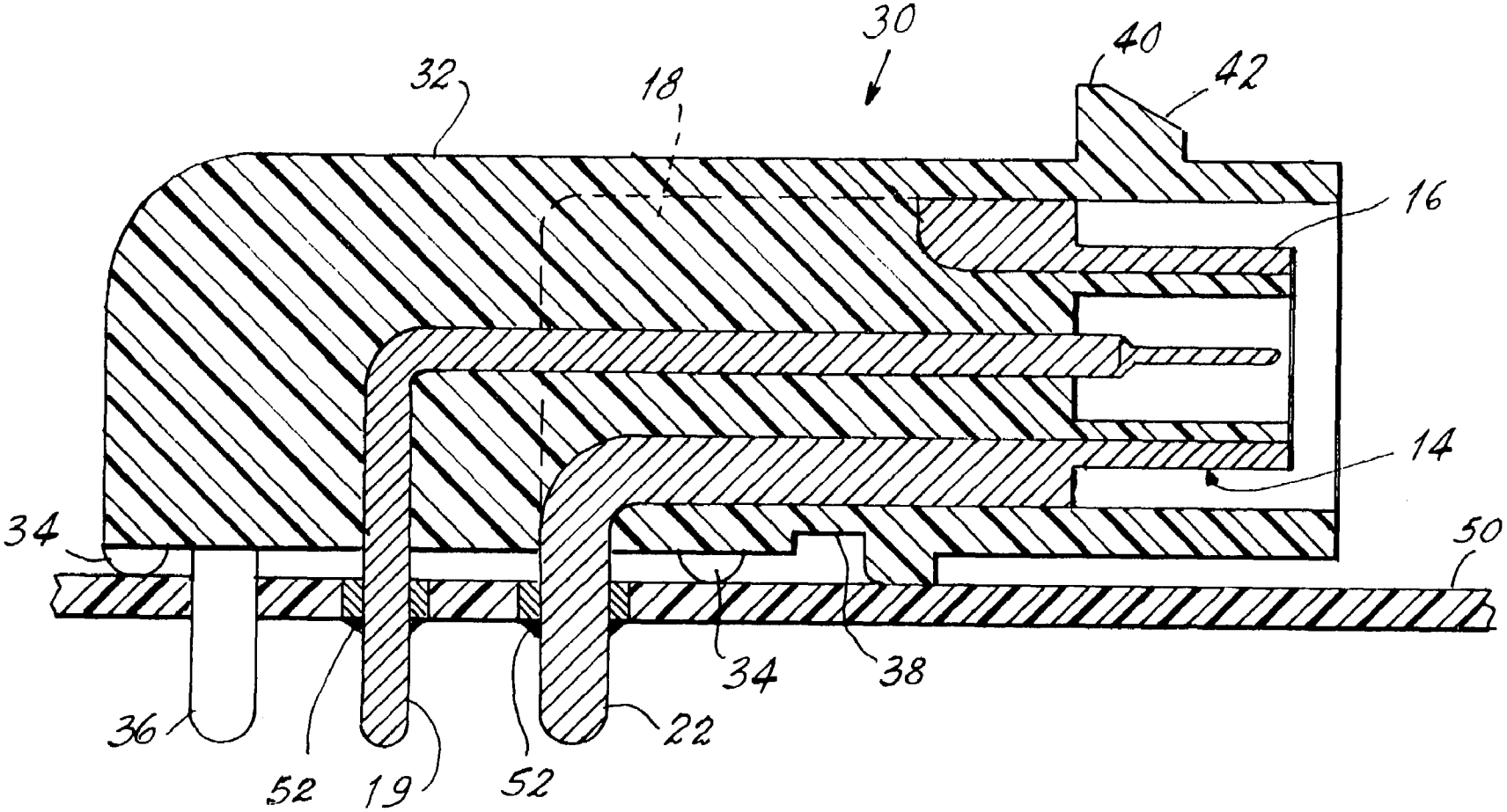
FIG. 3 is a sectional view of the completed connector with the insulating body molded in place.

Referring now to the drawings with greater particularity, there is shown in FIG. 1 a subassembly of a right-angled electrical connector. Specifically, a right-angled connector in accordance with an aspect of the invention comprises a subassembly 10 having an electrically conductive member or ground shell 12 having a longitudinal axis 13 with at least a portion 14 of the member 12 providing a cylindrical, hollow end 16. A trough 18 is formed in the member 12 to accommodate an electrically conductive contact pin 18*a* and at least one leg 19 is provided on member 12 extending in a direction transverse to the longitudinal axis 13. In a preferred embodiment of the invention the member 12 has two legs, 19, as shown in FIG. 2, which, in the final construction, will provide the ground connections for the connector, as will be explained hereafter. Member 12 can be any electrically conductive material but in a preferred embodiment of the invention it is die cast zinc.

Pin 18*a* has a first longitudinal part 20 that is substantially centrally located in the hollow end 16 and the trough 18; that is, the first longitudinal part 20 is coaxial with the axis 13, and the pin 18*a* has a second part 22 that, in the right-angled connector shown, projects in a direction transverse to the longitudinal direction and the axis 13 and which, in the finished connector, will provide the electrical connection to the contact pin. Contact pin 18*a* can be any conductive material but is preferably brass.

To complete a connector 30, the subassembly 10 is mounted in a suitable mold cavity with the pin 18*a* held in its appropriate position by tooling, not shown.

The single-piece, electrically insulating body 32 is then over-molded around the subassembly 10. The body 32 can take any appropriate or desired configuration but in a preferred embodiment includes at least two and preferably four spacing feet 34 and at least one but preferably two compressible legs 36.

A stabilizing slot 38 can be include to accommodate stresses that may occur in the molded body 32 and a tab 40 with a ramp 42 can also be provided to lock in a suitable opening in a mating connector.

In use the connector 30 is mounted upon a PCB 50 with the compressible legs 36 engaging suitable openings in the PCB and the legs 19 and the second part 22 of pin 18*a* engaging plated-through holes in the PCB. The spacing feet 34 are in contact with one surface of the PCB and serve to provide consistent spacing for the connector 30. After mounting the connector 30 to the PCB 50 appropriate solder 52 can be applied to insure adequate electrical connection to the legs 19 and the second part 22 of contact 18*a*.

There is thus provided a new and much simpler and more economical electrical connector. Only three parts are employed and the single-piece body greatly increases the strength of the connector.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A connector comprising:

an electrically conductive member having a longitudinal section at least a portion of which provides a cylindrical hollow end;

an electrically conductive pin positioned with respect to said electrically conductive member, a first part of said electrically conductive pin being substantially centrally located within said hollow end: and a single-piece electrically insulating body surrounding said electrically conductive member and said electrically conductive pin, said electrically conductive member having at least one leg extending in a direction transverse to said longitudinal axis and having a length sufficient to extend beyond a surface of said electrically insulating body, said electrically insulation body being provided with at least two spacing feet and at least one compressible leg.

2. The connector of claim 1 wherein said connector is a right-angle connector.

3. The connector of claim 1 wherein said electrically conductive pin has a second part projecting in a direction transverse to said first part.

4. The connector of claim 3 wherein said second part of said conductive pin extends beyond a surface of said electrically insulating body.

* * * * *